US007042108B2

(12) United States Patent
Farkas

(10) Patent No.: US 7,042,108 B2
(45) Date of Patent: May 9, 2006

(54) BACKUP POWER SYSTEM

(76) Inventor: Otto Farkas, 1749 SE. 44rth Ter., Cape Coral, FL (US) 33904

( * ) Notice: Subject to any disclaimer, the term of this patent is extended or adjusted under 35 U.S.C. 154(b) by 185 days.

(21) Appl. No.: 10/772,301

(22) Filed: Feb. 6, 2004

(65) Prior Publication Data

US 2005/0173925 A1 Aug. 11, 2005

(51) Int. Cl.
*B60K 25/06* (2006.01)
*F16D 11/00* (2006.01)
*H01F 1/00* (2006.01)

(52) U.S. Cl. ..... 290/3; 290/40 C; 180/53.1; 307/64; 307/68

(58) Field of Classification Search ..... 290/3, 290/40 C; 180/53.1; 307/64, 68
See application file for complete search history.

(56) References Cited

U.S. PATENT DOCUMENTS

| | | | | | |
|---|---|---|---|---|---|
| 2,911,541 | A | | 11/1959 | Neufville | 290/1 R |
| 2,941,137 | A | * | 6/1960 | Fehn, Sr. | 318/161 |
| 3,187,250 | A | * | 6/1965 | Born et al. | 322/32 |
| 3,272,294 | A | * | 9/1966 | Wainwright | 192/24 |
| 3,675,112 | A | | 7/1972 | Smith | 322/4 |
| 3,683,255 | A | * | 8/1972 | Schroeder | 322/35 |
| 4,231,443 | A | * | 11/1980 | van der Lely | 180/53.1 |
| 4,238,692 | A | | 12/1980 | An et al. | 307/106 |
| 4,240,514 | A | * | 12/1980 | van der Lely | 180/53.1 |
| 4,467,663 | A | * | 8/1984 | van der Lely | 74/15.4 |
| 4,827,152 | A | | 5/1989 | Farkas | 307/68 |
| 4,857,755 | A | * | 8/1989 | Comstock | 307/47 |
| 5,031,746 | A | * | 7/1991 | Koivunen | 192/85 AA |
| 5,637,049 | A | * | 6/1997 | Zentmyer et al. | 475/231 |
| 5,759,126 | A | * | 6/1998 | Zentmyer et al. | 475/150 |
| 5,759,129 | A | * | 6/1998 | Zentmyer et al. | 475/231 |
| 5,816,971 | A | * | 10/1998 | Zentmyer et al. | 475/84 |
| 6,020,657 | A | | 2/2000 | Liran | 307/64 |
| 6,133,716 | A | | 10/2000 | Schutten | 322/40 |
| 6,204,572 | B1 | | 3/2001 | Liran | 307/64 |
| 6,320,279 | B1 | | 11/2001 | Jimenez | 307/64 |
| 6,507,128 | B1 | | 1/2003 | King et al. | 290/40 C |
| 6,614,132 | B1 | * | 9/2003 | Hockney et al. | 307/43 |
| 6,657,321 | B1 | * | 12/2003 | Sinha | 307/68 |
| 2002/0101119 | A1 | | 8/2002 | Eisenhaure | 307/64 |
| 2003/0137196 | A1 | | 7/2003 | Liran | 307/64 |

* cited by examiner

*Primary Examiner*—Darren Schuberg
*Assistant Examiner*—Pedro J. Cuevas
(74) *Attorney, Agent, or Firm*—Terry M. Gernstein

(57) ABSTRACT

A backup power system is connected in parallel to a load which is powered via a power line connecting that load to a main power source, such as a utility. The backup system includes a generator/condenser unit that is coupled to a flywheel unit to maintain the flywheel of that flywheel unit rotating at a preset speed during normal power system operation and is also connected to a thermal engine to supply power to the load via the generator/condenser unit when there is an interruption of power from the main power source. A shaft coupling unit slidably couples the generator/condenser unit to the flywheel unit. The shaft coupling unit includes a slip plate. Part of the shaft coupling unit rotates in accordance with the operation of the generator/condenser unit, while with the slip plate rotates in accordance with the flywheel of the flywheel unit. Rotation of the generator/condenser unit is monitored by a sensor and rotation of the flywheel is also monitored. A circuit generates a signal which activates the thermal engine when rotational speed of the generator/condenser unit differs from rotational speed of the flywheel by a preset margin.

5 Claims, 6 Drawing Sheets

BACKUP POWER SYSTEM

TECHNICAL FIELD OF THE INVENTION

The present invention relates to the general art of electrical transmission, and to the particular field of emergency and standby electrical power.

BACKGROUND OF THE INVENTION

Sensitive loads, such as computers, data processing equipment, communications equipment, and the like, require stable and uninterrupted power. Accordingly, many such items include battery backup power supplies. However, battery power is not sufficient for large power grids, such as might be associated with utility power sources. Furthermore, battery failures due to constant charging are a common problem in the standby power generation industry and thus battery backup systems may have problems, including reliability problems.

Therefore, there is a need for a standby and backup power system that does not require batteries.

Synchronous condensers and synchronous motors are used on power systems where large amounts of reactive KVA are needed for power factor correction and voltage regulation. A synchronous condenser is similar to a synchronous motor, but is built to operate without a mechanical load, primarily to supply reactive KVA, which is main component of voltage regulation and stabilization. For example, on a decrease of Line Voltage down to 70% of rated, the leading reactive component of a leading power factor machine will increase maintaining constant voltage to the load to which it is connected. On over voltage, for example up to 10% of rated, the reactive component of a leading power factor machine will decrease maintaining constant voltage to the load to which it is connected. Synchronous condensers, due to their low impedance and ability to generate reactive KVA will protect a load by filtering out transients and maintaining constant voltage during sags and interruptions. However, during longer interruption of utility power, synchronous condensers may be inadequate.

Synchronous machines are also ideal components in dynamic No-Break or Continuous power systems since they can constantly rotate on a line connected to the utility with the load being a condenser or a generator.

Therefore, large systems often utilize rotating continuous electric power generation systems as a source of standby or backup power. Such standby or backup power systems are connected in parallel with utility power. Such systems must constantly monitor voltage, frequency and power shape and should be able to detect irregularities and disconnect instantly from the utility when an indicia of power falls below a preset value or when power is interrupted.

When a synchronous condenser is coupled to a mechanical load for use in a continuous or no-break power system, during voltage sags or interruptions, the mechanical load will instantly turn the condenser into a generator. This will change the Vector and the Power Factor of the machine. Therefore, instead of generating the leading reactive current necessary for voltage regulation, it begins to generate KW. Once the condenser turns into a generator, the re-connect of the utility out of phase becomes a critical issue.

Power failure detection and isolation from utility source in time is a critical function for any rotating continuous power system since the synchronous machine (motor) instantly turns into a generator when electric drive power to it is interrupted. If a utility breaker is not immediately opened, the generator will back feed the entire grid and may also fail due to overload.

Therefore, rotating power protection systems use a variety of means to provide such immediate interruption. For example, some systems use computers and other digital equipment to monitor the power quality and send and receive signals to and from remote locations. The power to drive these devices usually comes from the generator. However, once the generator is connected in parallel to the utility, any disturbance on the utility line, such as lightning strikes or the like, may have direct consequences on these very same monitoring and protection devices. In some cases, these devices may fail to detect a power interruption in time or fail completely due to problems associated with their configurations and connections to the system. Such failure will render the entire power protection system useless.

In order to overcome some of the problems discussed above, some systems include a taped series reactor between the utility, the generator and the load. These systems are sometimes called "isolating couplings" or "line-interactive filters." With this configuration, voltage between the line and the tap is monitored as well as between the generator and the tap. The reactor will always provide a preset power factor and generate reactive power in both the line and the load direction in order to minimize possible damage during momentary interruptions as well as to provide reactive power for load regulation.

There are several problems with this solution. The inductor changes the load impedance during both normal and/or during emergency power generation and limits the short circuit clearing ability of the system or necessary current required for motor starting and other inductive type equipment thereby limiting its applications.

A–C frequency sensing switches are also used for power failure sensing. When power to a synchronous motor is interrupted, the rotating field of the machine begins to slow thereby generating lower frequency. Normally, these devices are set to disconnect the load and the machine from the utility at 59.9 Hz in a 60 Hz system. This only allows 0.5 Hz frequency deviations. However, during peak load conditions, it is quite common to have utility frequency variations of 0.5 Hz. Therefore, using any type of frequency or shift speed sensing device as a primary and only sensing method can be unreliable.

A solution is described in U.S. Pat. No. 5,684,348 which discloses a rotating field of a synchronous machine or coupling with a built in mechanical switch. The mechanical switch is allowed 90° electrical slip so that at the end of the slip, the switch can send a signal to isolate the machine from a faulty circuit. However, there are several problems with this approach. First, it may be difficult and costly to integrate a mechanical switch into a rotating Field of a generator or even a coupling and be able to send a contact signal. Furthermore, the described 90° electrical slip represents 0.5 Hz frequency loss even before the breaker open signal can be generated. Furthermore, the possibility of a utility reconnect at 90° out of phase may damage and may even destroy the coupling of the switch, or may even bend the shaft of the machine as well as create large transients.

Therefore, the amount of slack within the coupling should be minimized to maintain closer frequency regulation but long enough to provide the transitional KVA until the system is isolated from the faulty source.

Therefore, there is a need for a power system that is equipped with a positive failsafe system for monitoring and power failure sensing along with a reliable source of energy to start a standby machine.

More specifically, there is a need for a power system that is equipped with a positive failsafe system for monitoring and power failure sensing along with a reliable source of energy to start a standby thermal engine.

OBJECTS OF THE INVENTION

It is a main object of the present invention to provide a need for a power system that is equipped with a positive failsafe system for monitoring and power failure sensing along with a reliable source of energy to start a standby machine.

It is another object of the present invention to provide a power system that is equipped with a positive failsafe system for monitoring and power failure sensing along with a reliable source of energy to start a standby thermal engine.

It is another object of the present invention to provide a power system that is equipped with a mechanical failsafe system for monitoring and power failure sensing along with a reliable source of energy to start a standby thermal engine.

It is another object of the present invention to provide a power system that is equipped with a positive failsafe system for monitoring and power failure sensing along with a reliable source of energy to start a standby thermal engine and which provides an accurate and predictable ridethrough.

It is another object of the present invention to provide a positive failsafe system for monitoring and power failure sensing for a backup power system.

It is another object of the present invention to provide a positive failsafe system for monitoring and power failure sensing for a backup power system which includes a phas shift coupling which has a precise phase shift angle indicator and can be used for all synchronous machines while operating in parallel with other synchronous machines.

It is another object of the present invention to provide a positive failsafe system for monitoring and power failure sensing for a backup power system which allows a synchronous condenser to make a smooth transition to a synchronous generator without any voltage loss or without generating any transients during power interruptions.

It is another object of the present invention to provide a positive failsafe system for monitoring and power failure sensing and which includes a synchronous motor for a backup power system which protects the synchronous motor from pulling out of step.

It is another object of the present invention to provide a positive failsafe system for monitoring and power failure sensing and which includes a synchronous motor for a backup power system and which protects the synchronous motor from re-connecting to utility power out of phase.

It is another object of the present invention to provide a positive failsafe system for monitoring and power failure sensing for a backup power system which utilizes a thermal engine and which provides a correct anticipated load change signal to maintain constant speed of the thermal engine while permitting the thermal engine to operate efficiently.

SUMMARY OF THE INVENTION

These, and other, objects are achieved by a backup power system that includes a thermal motor and a flywheel system connected to a motor/generator (also referred to in this disclosure as a generator/condenser) via a mechanical coupling that includes a slip plate which can have a gear thereon. A sensor monitors the gear and generates signals according to the rate of gear rotation with a thermal motor control circuit receiving signals from the monitor. When the difference between motor/generator rotation and flywheel rotation reaches a pre-set value, the thermal motor is activated and power is supplied by the motor/generator from the thermal engine. A flywheel in the flywheel system can supply power to the motor/generator in the manner of a ride through system. The slip plate is thus driven by the generator/condenser during normal operation, and is driven by the flywheel during a ride through period, and is thereafter driven by the thermal engine. The control circuit also disconnects the system from the remainder of the power grid when the system is being used in a backup mode.

Using the backup power system embodying the present invention will thus accurately and reliably connect a backup power generator to a load and yet is not complicated or costly to install.

BRIEF DESCRIPTION OF THE DRAWING FIGURES

DETAILED DESCRIPTION OF THE PREFERRED EMBODIMENT OF THE INVENTION

Other objects, features and advantages of the invention will become apparent from a consideration of the following detailed description and the accompanying drawings.

Figure 1:
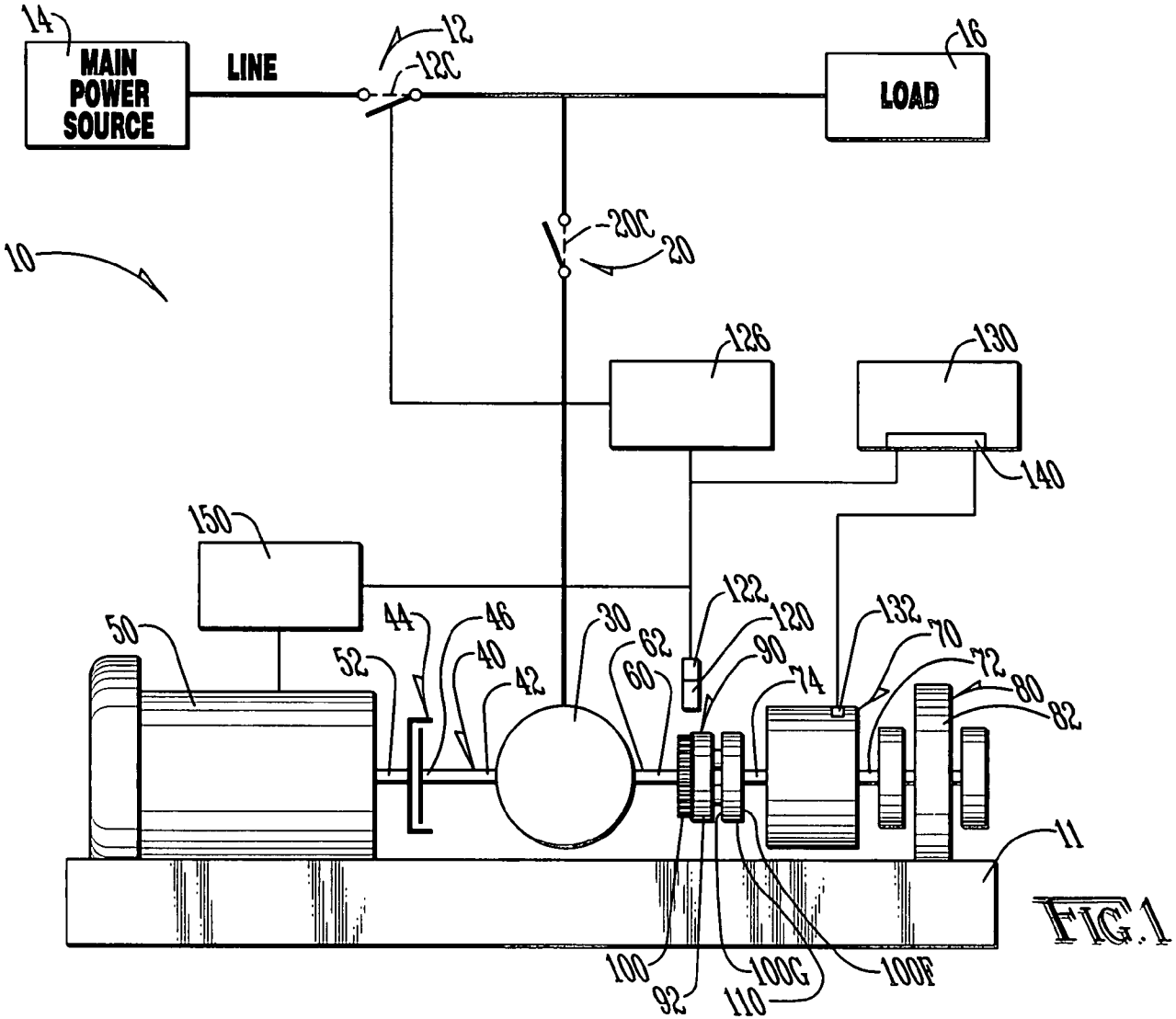
FIG. 1 is a schematic showing one form of a backup power system embodying the present invention.

Referring to FIGS. 1–3, it can be understood that the present invention is embodied in a backup power system 10. System 10 can be mounted on a skid 11.

System 10 comprises a line breaker switch 12 which is adapted to be electrically interposed between a main power source 14, such as a utility, and a load 16. Line breaker switch 12 has a closed condition which is indicated in FIG. 1 by dotted lines 12C, which electrically connects the main power source to the load and an open condition which is shown in solid lines in FIG. 1 which disconnects the load from the main power source.

A generator breaker switch 20 is electrically connected to the main power source in parallel with the load. Generator breaker switch 20 has a closed condition shown in FIG. 1 by dotted lines 20C and an open condition shown in solid lines in FIG. 1.

A generator/condenser unit 30 is electrically connected to the main power source via generator breaker switch to receive power when the line breaker switch is in the closed condition. Generator/condenser unit 30 has a main power source driven condition, a thermal engine driven condition and a flywheel driven condition as will be understood from the following disclosure.

A first drive shaft 40 is connected at one end 42 thereof to generator/condenser unit 30.

An overrunning clutch 44 is connected to first drive shaft 40 at a second end 46 of the first drive shaft.

A thermal engine 50 has an engine drive shaft 52 connected to generator/condenser unit 30 and via overrunning clutch 44 to drive the generator/condenser unit via the overrunning clutch when thermal engine 50 is activated.

A second drive shaft 60 is connected at a first end 62 thereof to generator/condenser unit 30. Second drive shaft 60 is rotatably driven by the generator/condenser unit when the generator/condenser unit is in the main power source driven condition and when the generator/condenser unit is in the thermal engine driven condition.

An input eddy current clutch 70 includes a first shaft 72 and a second shaft 74. Clutch 70 can be any form of clutch, and the magnetic form is merely one form of such a clutch.

A flywheel assembly 80 is connected to first shaft 72 of the input eddy current clutch. The flywheel assembly includes a flywheel 82 which is rotated at a predetermined rotational speed by generator/condenser unit 30 when unit 30 is operating in the main power source driven condition and when the generator/condenser unit is in the thermal engine driven condition.

A shaft coupling unit 90 connects flywheel assembly 80 via input eddy current clutch 70 to generator/condenser unit 30 via second drive shaft 60.

Figure 2B:
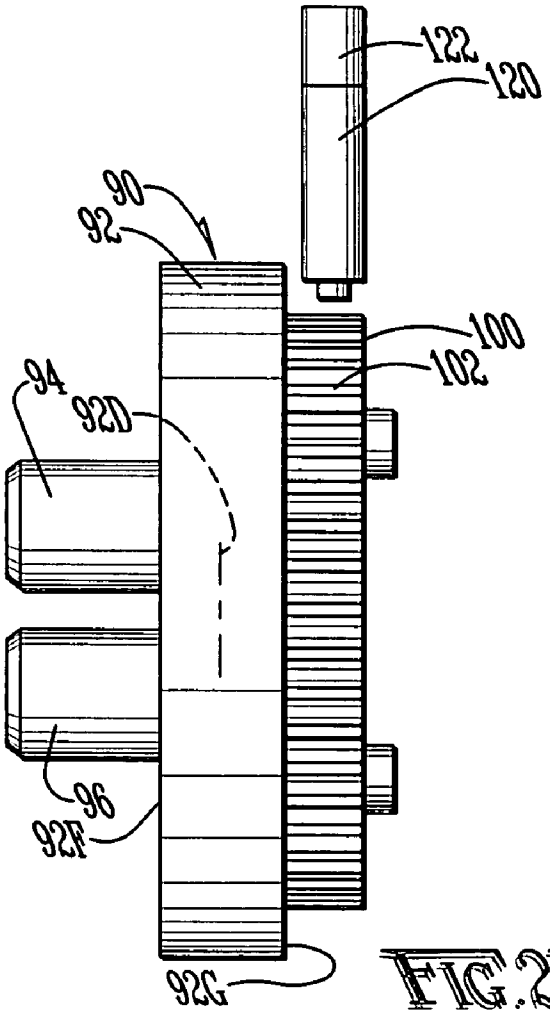
FIG. 2B is a side elevational view of the coupling shown in FIG. 2A.
Figure 2A:
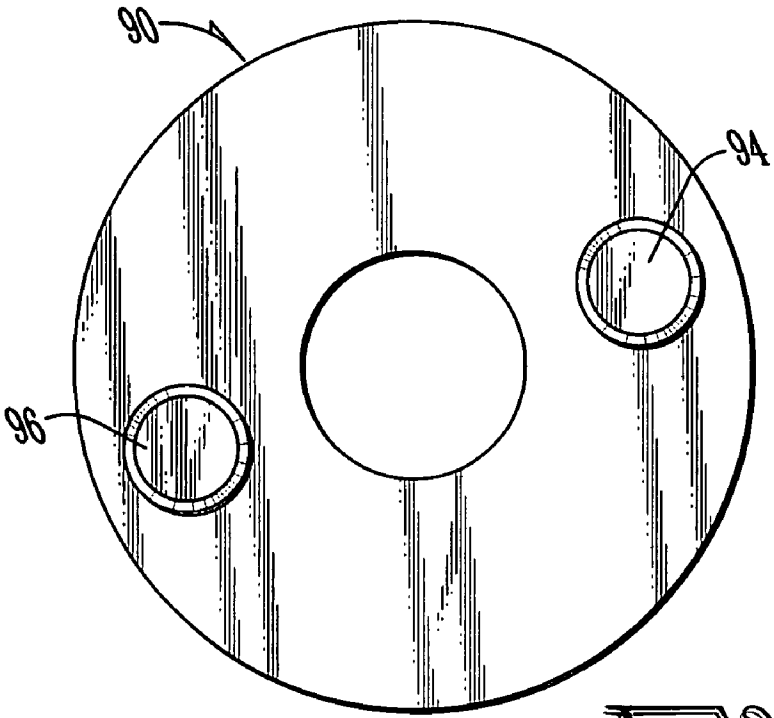
FIG. 2A is an plan view of a coupling included in the backup power system embodying the present invention as seen from the flywheel side of the coupling.

Shaft coupling unit 90 is shown in FIGS. 2A and 2B and includes a base 92 having a flywheel side face 92F, a generator/condenser side face 92G, and a diametric dimension 92D. Base 92 is fixedly mounted on second drive shaft 60 for rotation therewith.

Two stop pins 94 and 96 are mounted on the base on the flywheel side face. The stop pins can be removed from the base if suitable. The stop pins are spaced apart from each other in the direction of the diametric dimension of the base and extend away from a plane containing the flywheel side face of the base.

A toothed gear 100 is fixedly mounted on the generator/condenser side face of the base. Toothed gear includes a multiplicity of gear teeth, such as gear tooth 102, on the outer perimeter thereof. Toothed gear 100 rotates with second drive shaft 60 and the teeth will move at a rotational speed associated with the rotational speed of the second drive shaft. The purpose of this will be understood from the following disclosure.

A slip plate 110 is shown in FIGS. 1 and 3A–3C and is fixedly mounted on second shaft 74 of input eddy current clutch 70. Slip plate 110 includes a flywheel side face 110F, a generator/condenser side face 110G and a diametric axis 110D.

Two elongate slots 112 and 114 are defined through the slip plate and the elongate slots are spaced apart from each other in the direction of the diametric axis of the slip plate. Each elongate slot has a first end 116 and a second end 118 which is spaced apart from the first end. Each elongate slot is sized and located to slidingly accommodate a stop pin of the two stop pins mounted on the base. Generator/condenser unit 30 is slidingly associated with the flywheel unit via input eddy current clutch 70 when the slip plate is mounted on the stop pins on the base.

Figure 3C:
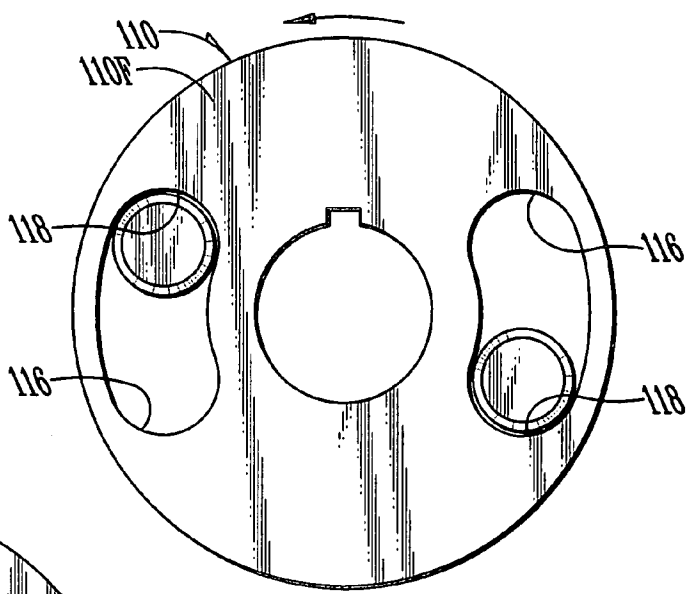
FIG. 3C shows the coupling shown in FIG. 3A with the direction of rotation of the coupling under the influence of a flywheel being indicated.
Figure 3B:
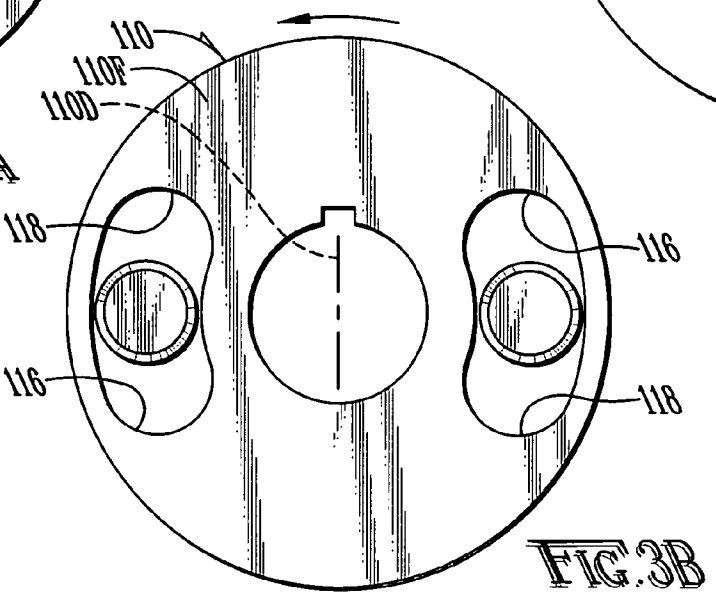
FIG. 3B shows the coupling shown in FIG. 3A during a transition during a power interruption.
Figure 3A:
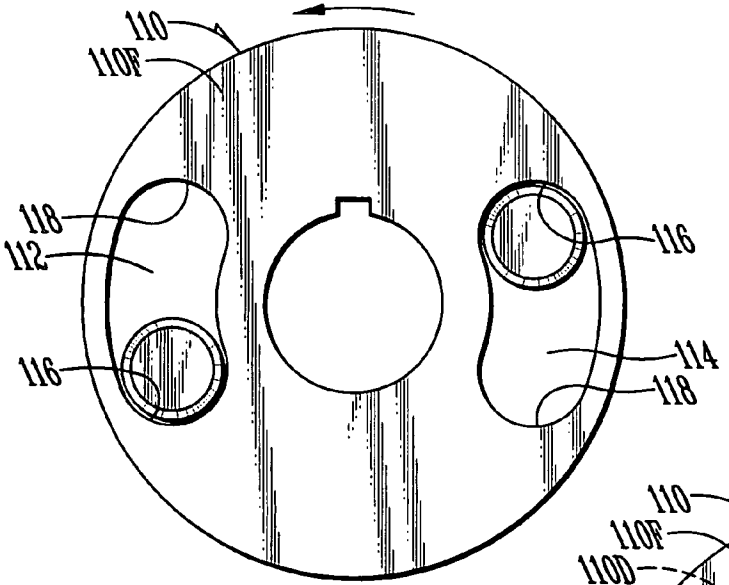
FIG. 3A is an elevational view of the coupling shown in FIG. 2A with the direction of rotation of the coupling under the influence of a motor/condenser unit being indicated.

As shown in FIGS. 3A–3C, the shaft coupling unit moves between a source power driven configuration shown in FIG. 3A, a thermal engine driven configuration, also shown in FIG. 3A, a transition configuration shown in FIG. 3B and a flywheel driven configuration shown in FIG. 3C, with each stop pin of the stop pins engaging the first end 116 of a slot accommodating the each stop pin the shaft coupling unit is in the main power source driven configuration and in the thermal engine driven configuration, and each stop pin of the two stop pins engaging the second end 118 the slot accommodating each stop pin when the shaft coupling unit is in the flywheel driven configuration, and both stop pins being spaced apart from both the first end and the second end of the slot accommodating the stop pin when the shaft coupling unit is in the transition configuration. As will be understood from the following disclosure, when the shaft coupling unit is in the transition configuration, the slip plate will rotate at a rotational speed that is different from the rotational speed of the second drive shaft.

A gear tooth sensor 120 is located adjacent to the toothed gear on the shift coupling unit. Gear tooth sensor 120 includes a circuit 122 which generates signals associated with a rate of rotational speed of second shaft 60.

A gear speed sensing circuit 126 is electrically connected to the gear tooth sensor and receives signals therefrom.

An input eddy current clutch speed sensing excitation unit 130 is electrically connected to the gear speed sensing circuit and to input eddy current clutch 70. Eddy current speed sensing excitation unit 130 includes a rotational speed sensor 132 associated with input eddy current clutch 130 to measure the rotational speed of the clutch and thus sense the rotational speed of the flywheel.

A comparator circuit 140 compares rotational speed of the input eddy current clutch as sensed by the rotational speed sensor associated with the input eddy current clutch to rotational speed of the second shaft as sensed by the gear speed sensing circuit. Comparator circuit 140 generates an activation signal when the rotational speed of the second drive shaft as sensed by the gear speed sensing circuit differs from the rotational speed of the input eddy current clutch (and hence the rotational speed of the flywheel) as sensed by the rotational speed sensor associated with the input eddy current clutch by a pre-set margin. Line breaker switch 12 is opened upon receiving the activation signal from the comparator circuit and moves from a closed condition to an open condition.

A thermal engine controller 150 is connected to thermal engine 50 to activate and de-activate the thermal engine. Thermal engine 50 is activated when the thermal engine controller receives the activation signal from comparator circuit 140. The eddy current speed sensing excitation unit and the gear speed sensing circuit are electrically connected together and to line breaker switch 12 and to thermal engine controller 150 to activate the thermal engine via the thermal engine controller when the speed of the input eddy current clutch as sensed by the eddy current clutch speed sensor and the speed of the second drive shaft as sensed by the gear speed sensing circuit differ by a preset amount.

The speed of eddy current clutch 70 being the same as the speed of the second drive shaft when the generator/condenser unit is in the main power source driven condition and in the thermal engine driven condition and the shaft coupling unit is in the main power source driven condition and in the thermal engine driven condition. The speed of the eddy current clutch being different from the speed of the second drive shaft when the generator/condenser unit is in the transition condition and the shaft coupling unit is in the transition condition.

Figure 4:
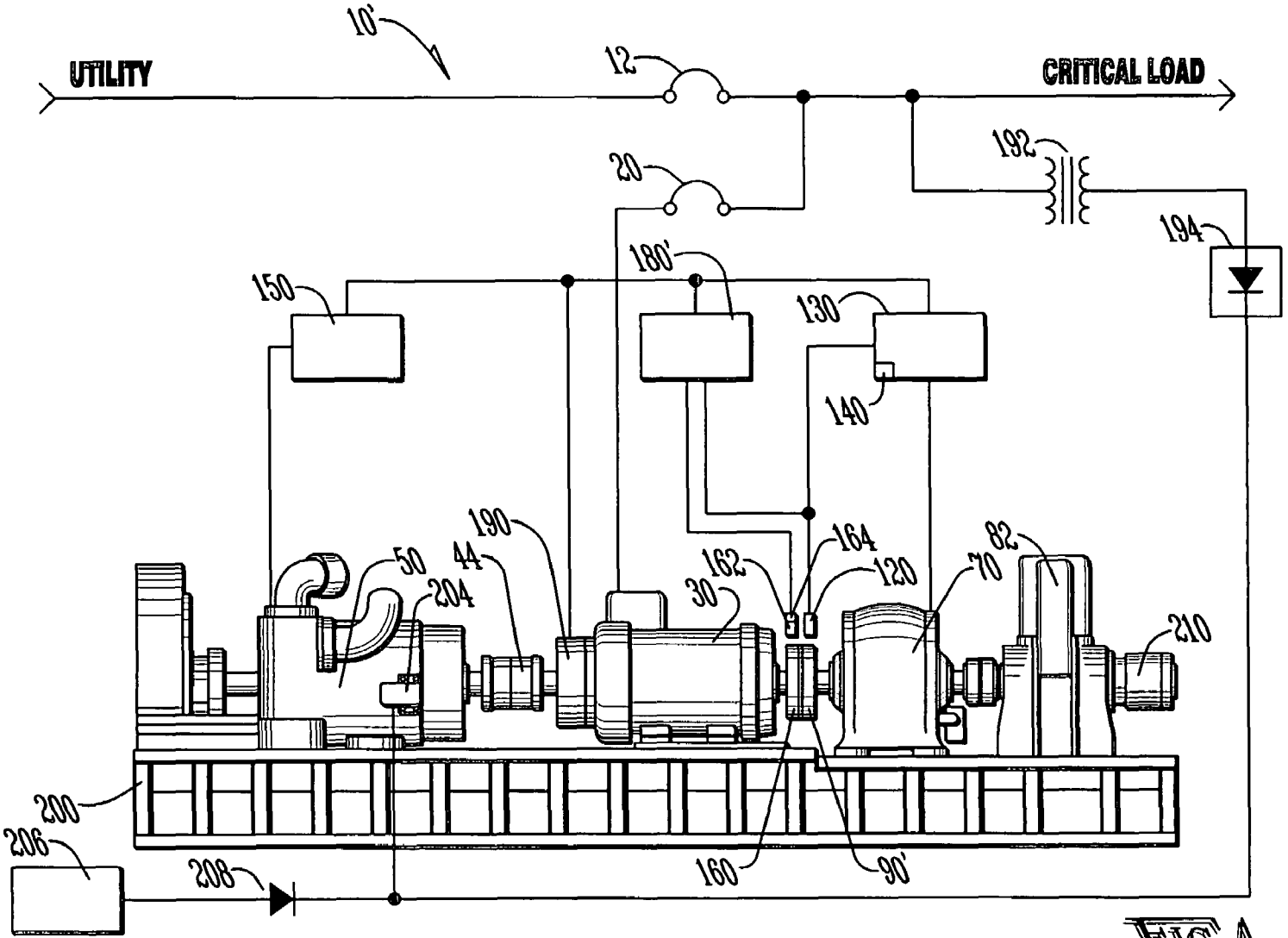
FIG. 4 is a schematic showing another form of a backup power system embodying the present invention.
Figure 5B:
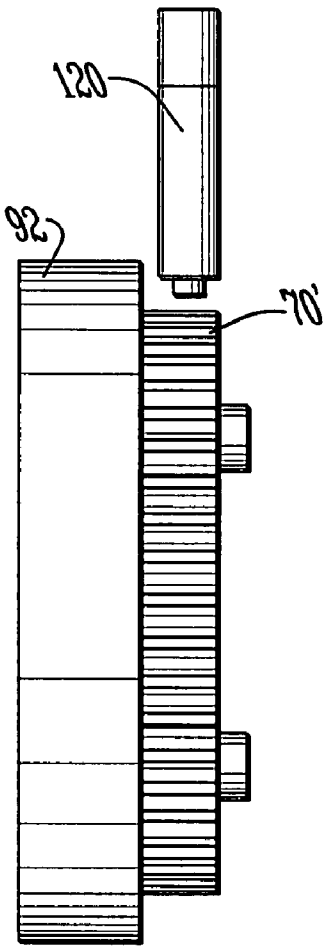
FIGS. 5A and 5B show side elevational views of a base of a shaft coupling unit included in the backup power system embodying the present invention.
Figure 5A:
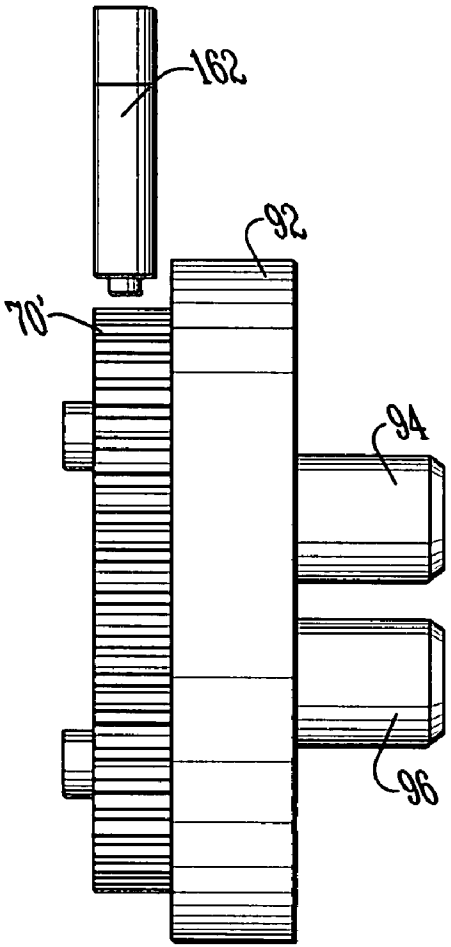
Figure 6B:
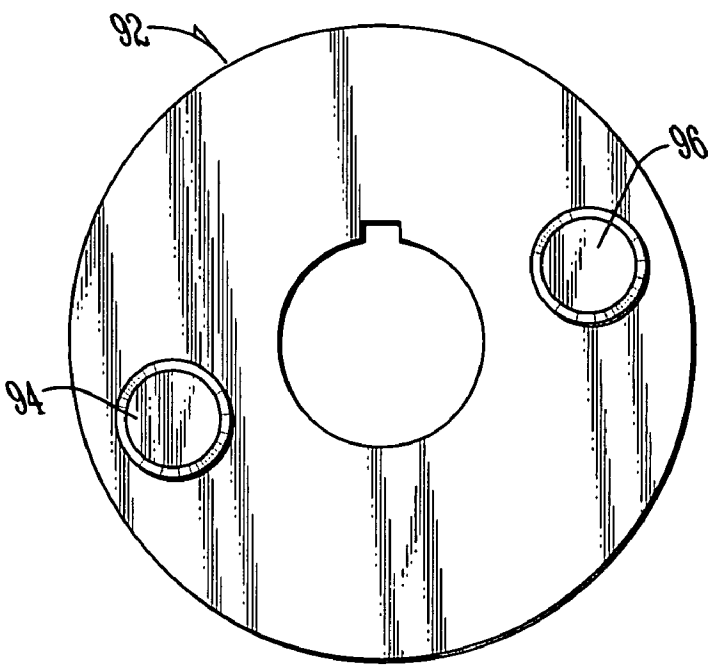
FIG. 6B shows a plan view of a base of the shaft coupling unit included in the backup power system embodying the present invention.
Figure 6A:
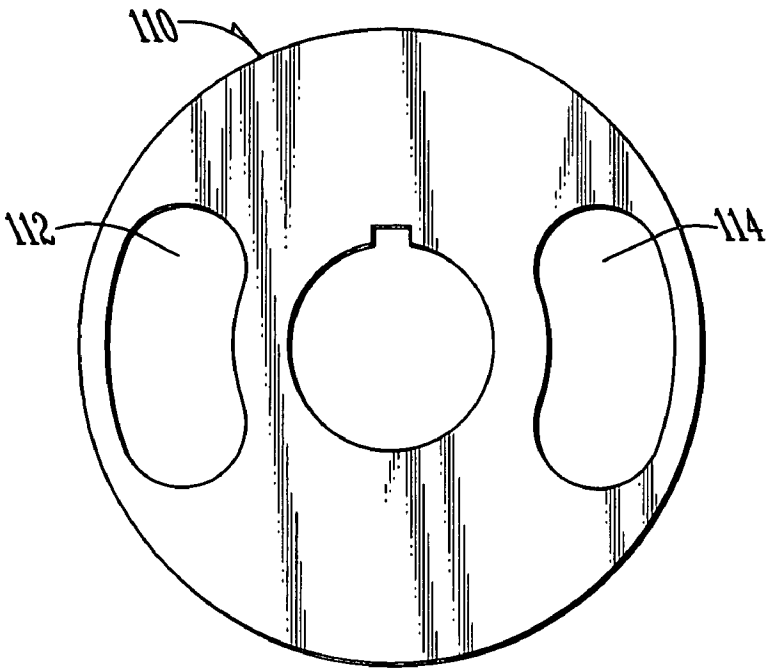
FIG. 6A shows a plan view of a slip plate of the shaft coupling unit included in the backup power system embodying the present invention.

As shown in FIGS. 4–6, another form of the backup power supply system 10' includes a shaft coupling unit 70' that includes a second toothed gear 160 on the slip plate and a second gear tooth sensor 162 located adjacent to the second toothed gear. Second gear tooth sensor 162 includes a circuit 164 which generates signals associated with the rate of rotational speed of the second gear, and hence which are associated with the rotational speed of second drive shaft 60. Second gear tooth sensor 162 is electrically connected to the comparator circuit.

Objectives of the backup system embodying the present invention are: to provide a failsafe mechanical power failure detection device; totally isolated power supply to all monitoring devices that control the entire system function; as well as to provide a reliable means and a redundant means of engine starting power.

FIGS. 3A–3C show the relative position of the two coupling plates as the synchronous machine drives the load when utility power is available or as the load drives the synchronous machine when utility power is interrupted. During loss of drive power, the synchronous machine side of the coupling slows with respect to the load side of the coupling. This change of speed between the two coupling plates, which only occurs when power to the synchronous motor is interrupted or falls below a certain value, is detected and used as a mechanical power failure indication.

FIGS. 5A and 5B show a magnetically sensitive metal gear mounted on both sides of a coupling assembly 70'. These figures also show the location of both magnetic pulse devices 120 and 102 adjacent to each gear coupling assembly. This enables sensing of each gear tooth passing the sensors and the sending of pulses from both sides of the coupling assembly to a digital speed sensing unit 180'. Unit 180', in turn, converts these pulses to degrees and frequency.

The amount of slip between the coupling assembly plates determines the amount of shaft speed or frequency loss and also provides a fixed time delay as to when the flywheel can actually engage the shaft of the synchronous machine and turn it into a generator. The coupling plates are allowed a 45° mechanical slip, which is equal to a 90° electrical difference in an 1800 rpm 4-pole machine.

A 14" diameter, 12-tooth cast-iron gear mounted on both sides of the coupling will each generate 3600 pulses per second, at the normal operating speed of 1800 rpm. Each pulse indicates 0.1°. During power interruption, the synchronous machine side of the coupling will slow to 3150 pulses per second as the coupling plate comes up to the stops, then it is re-accelerated to 3600 pulses per second by the load side of the coupling. This method provides 450 pulses or cycles per second in the same time frame as 0.5 Hz deviations by standard A–C frequency switches. Singals from both magnetic pulse generators are sent to a digital speed-sensing unit that compares the difference in speed signal change between the pulse generators as well as detects speed loss from both sides of the coupling. These signals are then sent to other control units that control the entire power system.

When the digital speed sensing unit receives 3400 pulses from magnetic pickup 162 and 3600 pulses from magnetic pickup 120, the indication is that the synchronous machine shaft (Field-Pole) has lost speed due to interruption or irregularity of utility power and it is now 20° out of phase. Line breaker switch 12 is opened to isolate the load. When the digital speed sensing unit receives 3150 pulses from magnetic pickup 162 and 3600 pulses from magnetic pickup 120 due to loss of drive power, the synchronous machine shaft (field-pole) is now 90° out of phase and has lost 0.5 Hz in frequency. Now the slip coupling has made its full slip so that energy to drive generator 30 can be supplied by flywheel 82. Therefore, eddy current clutch 70' is excited by control unit 130 by a signal from digital speed sensing unit 180'. A permanent magnet generator 190 is mounted on the synchronous machine shaft and will provide 120 VAC isolated electric power to the digital speed sensing unit as well as to all other monitoring and protective devices. In order to ensure reliable engine start during a power failure, a transformer 192 is connected to the critical load side of the buss and will provide the proper A/C power to a rectifier assembly 194 which has the capacity to provide the necessary amperage to crank the engine via its electric starter. During utility power interruption, the flywheel driven synchronous machine supplies the critical load power as well as provide reliable power for engine start.

The coupling shown in FIGS. 3A–3C can also be used in system 10. Referring back to FIGS. 3A–3C, the coupling is shown in several positions: FIG. 3A: as in the synchronous motor/condenser driving the mechanical load; FIG. 3B: shows the transition mode during power interruption; and FIG. 3C: shows the mechanical load driving the synchronous machine as a generator. These figures show how precisely the phase shift sensing unit controls the entire continuous power systems made up of thermal engine 50 coupled to generator 30 through overrunning clutch 44 with alternate power to drive generator 30 available from flywheel 82 coupled to eddy-current clutch 70 and through phase-shift coupling 90 or 90' with the entire unit mounted on a skid base 200.

At initial system start, the load is connected to the utility through breaker switch 12 while breaker switch 20 remains open. Engine crank power is available from the utility through breaker switch 12 through transformer 192, through blocking diode 194 to engine starter 204 or from battery 206 through blocking diode 208. Once engine 50 starts, it operates through overrunning clutch 44 and begins to turn the generator 30. As the system reaches 1800 rpm, the eddy current clutch is excited from excitation control module 180 and flywheel 82 is accelerated to approximately 1750 rpm at which time the eddy-current excitation is cut and pony motor 210 is energized to further accelerate the flywheel to 3600 rpm.

Once up to operating speed, generator 30 is synchronized to the utility and the load by closing breaker switch 20.

With line breaker switch 12 and generator breaker switch 20 closed, generator 30 turns into a motor and drives the eddy-current clutch output shaft at 1800 rpm through torque shaft coupling assembly 90 or 90'.

The input shaft of the eddy current clutch is directly connected to the flywheel assembly turning at 3600 rpm and is maintained by the pony motor.

When utility power quality drops or is interrupted, the rotating field of generator 30 begins to slow down. Therefore, pulses from magnetic pickup 162 also begin to drop. When pulses from magnetic pickup 162 drop to 3400 pulses, but the pulses from magnetic pickup 120 remain at 3600 pulses, the indication is that the generator rotating field has slowed down and its is 20° out of phase. At this point, the digital speed sensing unit 180 sends a signal to open line breaker switch 12. When pulses from magnetic pickup 162 drop to 3150 pulses but pulses from pickup 120 remain at 3600 pulses, the indication is that the generator rotating field has made the maximum 90° shift in the opposite direction of rotation. Thus, an excitation signal is given by digital speed control unit 180 to controller 130 which excites eddy-current clutch 70 thereby allowing the flywheel to drive the generator at a constant 1800 rpm through the eddy-current clutch and the coupling 90 or 90'.

When line breaker switch 12 opens, signals from the open breaker switch and from the pulse generator controller activate engine controller 150 to start the engine and bring it back to its operating speed and take the load from the flywheel (emergency mode). Once the load is on thermal engine 50, the eddy-current clutch excitation is cut and the flywheel is brought up to its operating speed of 3600 rpm by pony motor 210.

When utility power is restored, generator 30 with the load is re-synchronized to the utility by closing breaker switch 12 at which time thermal engine 50 is shutdown and generator 30 becomes a motor (normal operating mode).

It is understood that while certain forms of the present invention have been illustrated and described herein, it is not to be limited to the specific forms or arrangements of parts described and shown.

What is claimed is:

1. A backup power system comprising:

A) a line breaker switch which is adapted to be electrically interposed between a main power source and a load, said line breaker switch having a closed condition which electrically connects the main power source to the load and an open condition which disconnects the load from the main power source;

B) a generator breaker switch which is electrically connected to the main power source in parallel with the load, said generator breaker switch having a closed condition and an open condition;

C) a generator/condenser unit electrically connected to the main power source via said generator breaker switch to receive power when said line breaker switch is in the closed condition, said generator/condenser unit having a main power source driven condition, a thermal engine driven condition and a flywheel driven condition;

D) a first drive shaft connected at one end thereof to said generator/condenser unit;

E) an overrunning clutch connected to said first drive shaft at a second end of said first drive shaft;

F) a thermal engine having an engine drive shaft connected via said overrunning clutch to said generator/condenser unit to drive said generator/condenser unit via said overrunning clutch when said thermal engine is activated;

G) a second drive shaft connected at a first end thereof to said generator/condenser unit, said second drive shaft being rotatably driven by said generator/condenser unit when said generator/condenser unit is in the main power source driven condition and when said generator/condenser unit is in the thermal engine driven condition;

H) an input eddy current clutch, said input eddy clutch including a first shaft and a second shaft;

I) a flywheel assembly connected to the first shaft of said input eddy current clutch;

J) a shaft coupling unit connecting said flywheel assembly via said input eddy current clutch to said generator/condenser unit via said second drive shaft, said shaft coupling unit including (1) a base having a flywheel side face, a generator/condenser side face, and a diametric dimension, the base being fixedly mounted on said second drive shaft for rotation therewith, (2) two stop pins mounted on the base on the flywheel side face, the stop pins being spaced apart from each other in the direction of the diametric dimension of the base and extending away from a plane containing the flywheel side face of the base, (3) a toothed gear fixedly mounted on the generator/condenser side face of the base, (4) a slip plate fixedly mounted on the second shaft of said input eddy current clutch, said slip plate including (a) a flywheel side face, (b) a generator/condenser side face, (c) a diametric axis, (d) two elongate slots defined through the slip plate, the elongate slots being spaced apart from each other in the direction of the diametric axis of the slip plate, each elongate slot having a first end and a second end which is spaced apart from the first end, each elongate slot being sized and located to slidingly accommodate a stop pin of the two stop pins mounted on the base, said generator/condenser unit being slidingly associated with said flywheel unit via said input eddy current clutch when the slip plate is mounted on the stop pins on the base;

K) said shaft coupling unit moving between a source power driven configuration, a thermal engine driven configuration, a transition configuration and a flywheel driven configuration, with each stop pin of the stop pins engaging the first end of a slot accommodating the each stop pin when said shaft coupling unit is in the main power source driven configuration and in the thermal engine driven configuration, and each stop pin of the two stop pins engaging the second end the slot accommodating each stop pin when said shaft coupling unit is in the flywheel driven configuration, and both stop pins being spaced apart from both the first end and the second end of the slot accommodating the stop pin when said shaft coupling unit is in the transition configuration;

L) a gear tooth sensor located adjacent to the toothed gear on said shift coupling unit, said gear tooth sensor including a circuit which generates signals associated with a rate of rotational speed of said second shaft;

M) a gear speed sensing circuit electrically connected to said gear tooth sensor and receiving signals therefrom;

N) an input eddy current clutch speed sensing excitation unit electrically connected to said gear speed sensing circuit and to said input eddy current clutch, said eddy current speed sensing excitation unit including a rotational speed sensor associated with said input eddy current clutch;

O) a comparator circuit which compares rotational speed of said input eddy current clutch as sensed by the rotational speed sensor associated with said input eddy current clutch to rotational speed of said second shaft as sensed by said gear speed sensing circuit, said comparator circuit generating an activation signal when the rotational speed of said second drive shaft as sensed by said gear speed sensing circuit differs from the rotational speed of said input eddy current clutch as sensed by the rotational speed sensor associated with said input eddy current clutch by a pre-set margin, said line breaker switch being opened upon receiving the activation signal from the comparator circuit;

P) a thermal engine controller connected to said thermal engine to activate and de-activate said thermal engine, said thermal engine being activated when said thermal engine controller receives the activation signal from said comparator circuit;

Q) said eddy current speed sensing excitation unit and said gear speed sensing circuit being electrically connected together and to said line breaker switch and to said thermal engine controller, to activate said thermal engine via said thermal engine controller when the speed of said input eddy current clutch as sensed by said eddy current clutch speed sensor and the speed of said second drive shaft as sensed by said gear speed sensing circuit differ by a preset amount; and R) the speed of said eddy current clutch being the same as the speed of said second drive shaft when said generator/condenser unit is in the main power source driven condition and in the thermal engine driven condition and the shaft coupling unit is in the main power source driven condition and in the thermal engine driven condition, and the speed of said eddy current clutch being different from the speed of said second drive shaft when said generator/condenser unit is in the transition condition and the shaft coupling unit is in the transition condition.

2. The backup power system defined in claim 1 further including a second toothed gear on the slip plate, a second gear tooth sensor located adjacent to the second toothed gear, said second gear tooth sensor including a circuit which generates signals associated with the rate of rotational speed of said second gear, said second gear tooth sensor being electrically connected to said comparator circuit of said input eddy current clutch speed sensing excitation unit.

3. The backup power system defined in claim 1 wherein the stop pins of said shaft coupling unit are removably mounted on the base of said shaft coupling unit.

4. A backup power system comprising:

A) a generator/condenser unit which is adapted to be connected in parallel with a load which is electrically connected to a main power source;

B) a thermal engine having a controller, said thermal engine being connected to said generator/condenser unit to drive said generator/condenser unit when said thermal engine is activated;

C) a flywheel unit, said flywheel unit including a flywheel;

D) a coupling unit coupling said flywheel unit to said generator/condenser unit, said coupling unit including (1) a base having a flywheel side face, a generator/condenser side face, and a diametric dimension, the base being connected to said generator/condenser unit, (2) two stop pins mounted on the base on the flywheel side face when in a use condition, the stop pins being spaced apart from each other in the direction of the diametric dimension of the base and extending away from a plane containing the flywheel side face of the base when in the use condition, and (3) a slip plate connected to said flywheel unit, said slip plate including (a) a flywheel side face, (b) a generator/condenser side face, (c) a diametric axis, (d) two elongate slots defined through the slip plate, the elongate slots being spaced apart from each other in the direction of the diametric axis of the slip plate, each elongate slot having a first end and a second end which is spaced apart from the first end, each elongate slot being sized and located to slidingly accommodate a stop pin of the two stop pins mounted on the base, said generator/condenser being slidingly associated with said flywheel unit when the slip plate is mounted on the stop pins on the base;

E) said shaft coupling unit moving between a source power driven configuration, a thermal engine driven configuration, a transition configuration and a flywheel driven configuration, with each stop pin of the stop pins engaging the first end of a slot accommodating the each stop pin when said shaft coupling unit is in the source power driven configuration and in the thermal engine driven configuration, and each stop pin of the two stop pins engaging the second end a slot accommodating each stop pin when said shaft coupling unit is in the flywheel driven configuration, and both stop pins being spaced apart from both the first end and the second end of the slot accommodating the stop pin when said shaft coupling unit is in the transition configuration;

F) a shaft speed sensor located adjacent to said shift coupling unit, said shaft speed sensor including a circuit which generates signals associated with a rate of rotational speed of said second shaft;

G) a shaft speed sensing circuit electrically connected to said shaft speed sensor and receiving signals therefrom;

H) a flywheel speed sensing unit electrically connected to said shaft speed sensing circuit and to the flywheel of said flywheel unit, said flywheel speed sensing unit including a rotational speed sensor associated with the flywheel of said flywheel unit;

I) a comparator circuit which compares rotational speed of the flywheel of said flywheel unit as sensed by said flywheel speed sensing circuit to rotational speed of said second shaft as sensed by said shaft speed sensing circuit, said comparator circuit generating an activation signal when the rotational speed of said second drive shaft as sensed by said shaft speed sensing circuit differs from the rotational speed of the flywheel of said flywheel unit as sensed by the flywheel speed sensing circuit by a pre-set margin;

I) said flywheel sensing circuit and said shaft speed sensing circuit being electrically connected together and to said thermal engine controller, to activate said thermal engine via said thermal engine controller when the speed of the flywheel of said flywheel unit and the speed of said second drive shaft as sensed by said shaft speed sensing circuit differ by a preset amount; and J) the speed of the flywheel of said flywheel unit being the same as the speed of said second drive shaft when said generator/condenser unit is in the main power source driven condition and in the thermal engine driven condition and the shaft coupling unit is in the main power source driven condition and in the thermal engine driven condition, and the speed of the flywheel of said flywheel unit being different from the speed of said second drive shaft when said generator/condenser unit is in the transition condition and the shaft coupling unit is in the transition condition.

5. A backup power system comprising:

A) a coupling unit which includes (1) a base having a first side face, a second side face, and a diametric dimension, (2) two stop pins which are mounted on the base on the first side face when in a use configuration, the stop pins being spaced apart from each other in the direction of the diametric dimension of the base and extending away from a plane containing the first side face of the base when in the use configuration, (3) a slip plate which includes (a) a first side face, (b) a second side face, (c) a diametric axis, (d) two elongate slots defined through the slip plate, the elongate slots being spaced apart from each other in the direction of the diametric axis of the slip plate, each elongate slot having a first end and a second end which is spaced apart from the first end, each elongate slot being sized and located to slidingly accommodate a stop pin of the two stop pins mounted on the base;

B) a backup power source connected to base of said coupling unit; and

C) a flywheel unit connected to the slip plate of said coupling unit.

* * * * *